United States Patent [19]

Tager

[11] 4,333,472

[45] Jun. 8, 1982

[54] COMPENSATORY-CORRECTIVE ORTHOPEDIC FOOT DEVICES

[76] Inventor: Steven E. Tager, 20445 Pacifica Dr., Cupertino, Calif. 95014

[21] Appl. No.: 108,799

[22] Filed: Dec. 31, 1979

[51] Int. Cl.[3] ..... A61F 5/14

[52] U.S. Cl. ..... 128/581

[58] Field of Search ..... 128/581, 583, 584, 585, 128/600, 615, 613, 614, 621

[56] References Cited

U.S. PATENT DOCUMENTS

| | | | |
|---|---|---|---|
| 1,958,097 | 5/1934 | Shaw | 128/585 |
| 2,567,028 | 9/1951 | Rapisarda | 128/614 |
| 2,616,190 | 11/1952 | Darby | 128/583 X |
| 2,990,629 | 7/1961 | McLaughlin | 128/614 |
| 3,244,176 | 4/1966 | Neu | 128/614 X |

FOREIGN PATENT DOCUMENTS

| | | | |
|---|---|---|---|
| 133683 | 1/1933 | Austria | 128/614 |
| 233603 | 3/1910 | Fed. Rep. of Germany | 128/614 |
| 1096802 | 1/1961 | Fed. Rep. of Germany | 128/581 |
| 654985 | 4/1929 | France | 128/614 |

*Primary Examiner*—John D. Yasko

*Attorney, Agent, or Firm*—Barlow & Barlow

[57] ABSTRACT

The present invention consists of the construction and specific application of a series of differentially-sized geometrically-shaped and specifically configured, generally wedge-shaped, prosthetic devices being structures composed of urethane foam that are to be utilized in the compensatory treatment of specific clinical structural biomechanical abnormalities of the human foot. These prosthetic foot devices are disposed in relation to anatomical specific regions in the footwear of the subject. Both the rear foot and the fore foot areas are the specific structural corrective regions with either or both a varus or valgus correction being the indicated reason for application of the device.

12 Claims, 9 Drawing Figures

COMPENSATORY-CORRECTIVE ORTHOPEDIC FOOT DEVICES

BACKGROUND OF THE INVENTION

This invention relates generally to orthopedic compensatory corrective devices applied to the foot. This invention relates more specifically to orthopedic compensatory-corrective devices that are to be disposed in footwear and applied for the correction and/or compensatory treatment of structural foot abnormalities or faulty architecture of the human foot with their resultant numerous bodily disorders and physical symptoms.

Frequently a patient is seen by a physician or podiatric specialist for symptoms that are confined and related to the lower extremities, these symptoms being localized in either one or more specific structural areas. Physical, biomechanical examination of the subject often leads to an identification or diagnosis by the physician of one or more specific structural abnormalities in the foot structure of the patient that are primarily responsible for these attendant symptoms.

The areas of the human foot in which these specific structural abnormalities have been found to be localized are either the fore foot or the rear foot regions. These structural abnormalities may be generically classified as either of the varus or valgus type. The valgus abnormality refers specifically to a foot position wherein the joint is turned outward or everted, that is away from the body midline to an abnormal degree. The varus abnormality, on the other hand, is a condition of the foot being turned inward or inverted, that is towards the body midline to an abnormal degree.

Previous applications of prior art devices to a shoe, or insole in a shoe, that have been designed for arch problems are known. See, for example, U.S. Pat. Nos. 2,081,474 (Burns), 2,427,986 (Whitman), and 1,804,009 (Gregarek). We find in examining these prior art devices essentially a generalized arch-supporting means designed to support faulty arches and prevent further weakening of the problem arch in the human foot. This approach is in clear contradistinction to the present invention whereby specifically designed prosthetic devices are applied to compensate for definite existing structural abnormalities of the human foot.

SUMMARY OF THE INVENTION

An object of the present invention is to provide an orthopedic compensatory-corrective device that is to be applied to the human foot.

Another object of the present invention is to provide an orthopedic compensatory-corrective device that is to be disposed in footwear and is to be worn for the correction and/or compensation of specifically indentified structural biomechanical abnormalities of the human foot.

A further object of the present invention is to provide a series of uniquely configured orthopedic compensatory devices that are to be applied inside footwear in relation to a specific area of structural biomechanical abnormality, thereby reducing or eliminating the manifest symptoms resulting from said specific structural foot abnormality.

Another object of the present invention is to provide a series of uniquely configured prosthetic orthopedic compensatory wedge-shaped devices that are to be applied inside footwear in either the anatomically defined rear foot or fore foot regions.

Another object of the present invention is to provide a series of uniquely configured orthopedic compensatory wedge-shaped devices to be applied inside footwear for the specific compensation of that structural biomechanical abnormality of the foot classified as either varus or valgus in nature.

Yet another object of the present invention is to provide a series of uniquely configured compensatory-corrective orthopedic wedge-shaped devices that are designed to be applied in a subject's footwear and that are easy to manufacture, being of relatively low cost to the ultimate consumer, as well as being of sturdy construction allowing for long term use if clinically necessary.

A series of differentially-sized irregularly-shaped specifically configured generally wedge-shaped orthopedic prosthetic compensatory-corrective devices being of urethane composition, are utilized in the treatment of specific clinical structural biomechanical abnormalities of the human foot. These unique prosthetic compensatory-corrective orthopedic foot wedges are disposed in relation to specifically identified anatomical regions in the footwear of the subject. Both the rear foot and the fore foot of the identified specific structural corrective regions, with either or both a varus or valgus abnormality correction being the indicated choice of application.

Other objects and advantages of the present invention will be apparent from the following description reference being had to the accompanying drawings wherein a preferred form of the embodiment of the present invention is clearly shown.

DESCRIPTION OF THE PREFERRED EMBODIMENT

Figure 1:
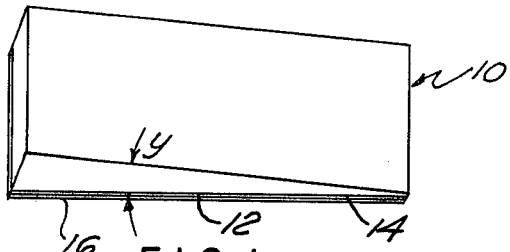
FIG. 1 is a perspective view of the varus fore foot cushion pad of the present invention.

Referring now to the drawings and more particularly to FIG. 1, which is a perspective view of the varus fore foot cushion pad of the present invention, we notice that the varus fore foot cushion pad 10 describes a rectangular outline, wedge-shaped configuration. The angle y is preferably in the range of from 2° to 6°. The overall length of the varus fore foot cushion pad varies in its multiple sized series configurations in a range of between 2.5 to 3.5 inches. The overall width of the structure in its various configured sizes is 1.75 inches. The thickness of the varus cushion pad at its highest point being opposite the wedge angle varies from 0.317 to 0.383 inches, while its lowest point, at the angle position, varies from 0.015 to 0.067 inches. The varus fore foot cushion pad, as well as the other orthopedic devices of the present invention, is composed of urethane foam material, assuring a necessary structural counter resiliency, as well as a space conforming structure having great durability. The lower surface 12 of the varus cushion pad, as well as the other devices of the present invention, may be supplied with an adhesive coating 14 and is covered by a peel-off protective covering 16.

Figure 2:
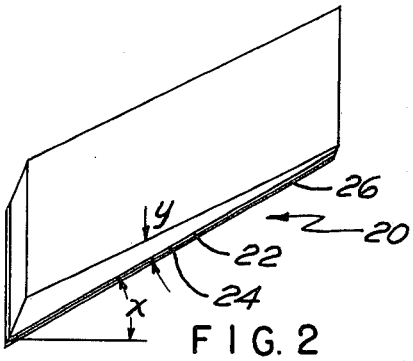
FIG. 2 is a perspective view of the valgus fore foot cushion pad of the present invention.

FIG. 2 is an elevational view of the valgus fore foot cushion pad of the present invention. We observe that the valgus fore foot cushion pad 20 describes also a parallelogram, wedge-shaped configuration. The angle y of the wedge in this structural configuration may vary in the range of between 2° and 6° while the outline of the pad is oblique at an angle x that is on the order of 30°. The overall length of the valgus fore foot cushion pad varies in its multiple sized series configurations from 3.00 to 2.375 inches. The overall width of the structure in its various configured sizes is 1.50 inches. The thickness of the valgus cushion pad at its highest point being opposite the edge of the angle, varies from 0.303 to 0.378 inches, while its lowest point at the angle position may vary from 0.015 to 0.067 inches. The adhesive coating 22 is distributed evenly on the pad's lower surface 24 and is protected by a peel-off cover 26 prior to its placement in the subject's footwear.

Figure 3:
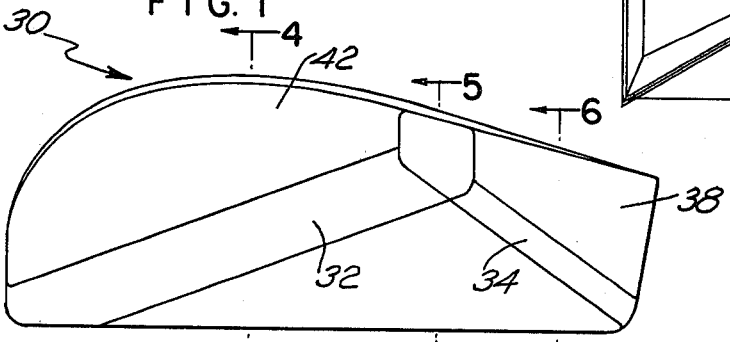
FIG. 3 is an elevational view of the calcaneous rear foot cushion pad of the present invention.

FIG. 3 is an elevational view of the calcaneous rear foot cushion pad of the present invention. We notice in this figure that the calcaneous cushion pad 30 has an irregularly-shaped outlined wedge-shaped configuration that might best be described as a truncated solid pyramidal shape which defines an elevated flat elongated platform. The individual wedge angles in this structural configuration varies from 6° to 24°. The overall length of the calcaneous rear foot cushion pad also varies in its multiple sized series configurations from 4.312 to 3.00 inches. The overall width of these structures at their widest point in various configured sizes ranges from 1.625 to 1.188 inches. Two ridges 32 and 34 divide the upper surface 36 into three irregularly-shaped distinct regions 38, 40 and 42, with region 40 sloping outwardly. The thickness of the calcaneous or rear foot cushion pad as measured at its highest point on the ridges 32 and 34, varies from 0.317 to 0.250 inches, while its lowest point at the peripheral angle shaped edges has an elevation of 0.15 inch. An adhesive coating 44 is distributed evenly on the pad's lower surface 46, and is protected by a peel-off cover 48 prior to the placement and attachment in the subject's footwear.

Figure 4:
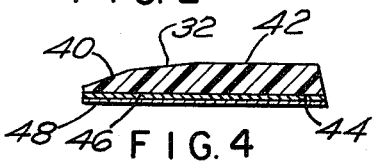
FIG. 4 is a cross sectional view of the calcaneous rear foot cushion pad of the present invention taken along line 4—4 of FIG. 3.
Figure 5:
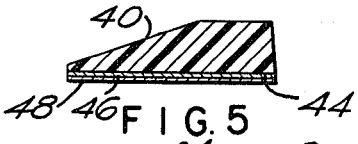
FIG. 5 is a cross sectional view of the calcaneous rear foot cushion pad of the present invention taken along line 5—5 of FIG. 3.
Figure 6:
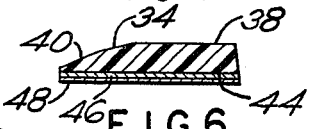
FIG. 6 is a cross sectional view of the calcaneous rear foot cushion pad of the present invention taken along line 6—6 of FIG. 3.

FIGS. 4, 5 and 6 are individual cross sectional views of the calcaneous or rear foot cushion pad of the present invention taken along lines 4—4, 5—5, and 6—6, respectively, of FIG. 3, in order to further illustrate the sloping and level surfaces of this device.

Figure 7:
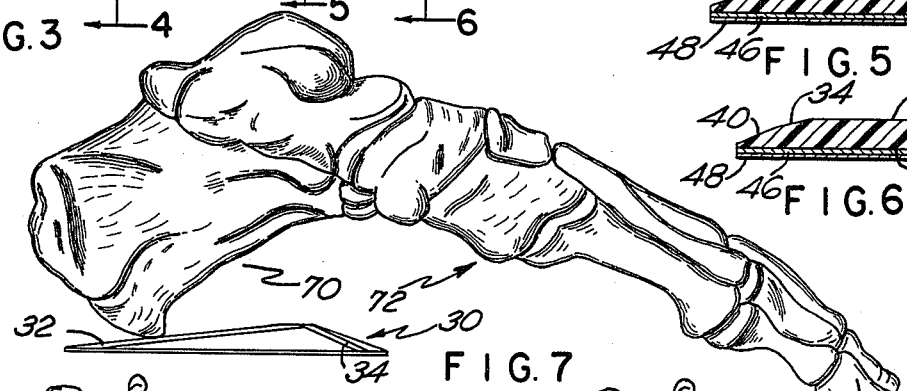
FIG. 7 is an elevational view of the calcaneous rear foot orthopedic device of the present invention with an elevational view of a skeleton of a foot showing the relative positions of the device and of the various bones of the foot.

FIG. 7 is a top plan view of the calcaneous rear foot varus orthopedic device of the present invention with a plan view of a skeleton of a foot superimposed thereon in order to show the relative positions of the device and the various bones of the foot.

We see that the calcaneous rear foot wedge 30 here is positioned below the calcaneum bone 70 of the rear foot region, and extending forward to the region of the cuneiform bones 72. Specific varus structural abnormalities related to this region of the foot are the focus of the specific placement of this compensatory device.

Figure 8:
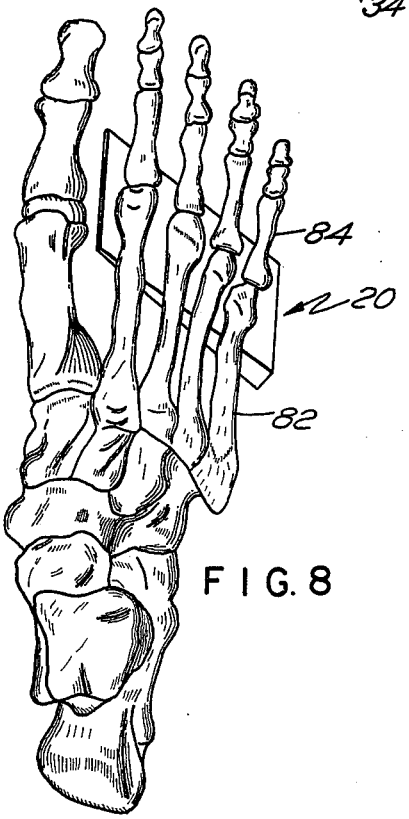
FIG. 8 is a top plan view of the fore foot valgus cushion pad of the present invention with a plan view of a skeleton of a foot superimposed thereon to show the relative position of this device and the various bones of the foot.
Figure 9:
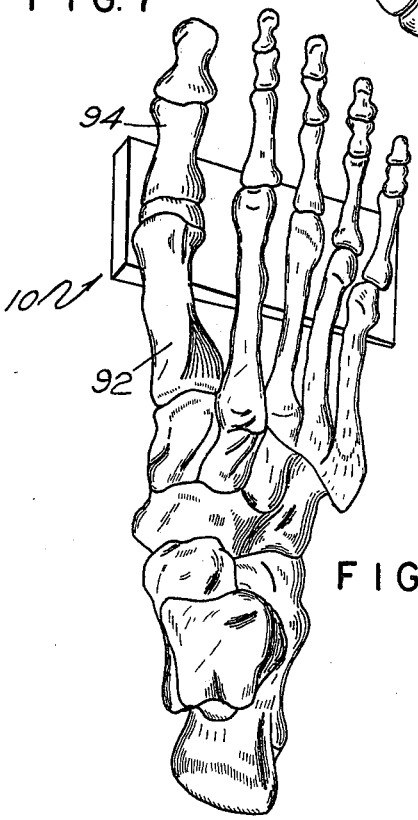
FIG. 9 is a top plan view of the fore foot varus cushion pad of the present invention with a plan view of a skeleton of a foot superimposed thereon to show the relative positions of the device and the various bones of the foot.

FIG. 8 is a top plan view of the fore foot valgus cushion pad of the present invention with a plan view of a skeleton of a foot superimposed thereon in order to show the relative positioning of this device and the various bones of the foot. It should be observed that the fore foot valgus cushion pad wedge 20 is positioned with the highest point of the wedge situated under the distal portion of the fifth metatarsal bone 82, and the fifth proximal phalanx 84. The wedge 20 extends transversely beneath the fourth, third, and second metatarsal bones as well as the fourth, third, and second proximal phalanges. This placement of the fore foot valgus cushion pad is specific for valgus structural abnormalities located in the fore foot region. FIG. 9 is a top plan view of the fore foot varus cushion pad of the present invention with a plan view of the skeleton of a foot superimposed thereon in order to show the relative positions of the device and the various bones of the foot. We notice that the fore foot varus cushion pad 10 is positioned with the highest point of the wedge situated under the distal portion of the first metatarsal bone 92, and the first proximal phalanx 94. The fore foot varus cushion pad 10 extends transversely beneath the second, third, fourth, and fifth metatarsal bones, as well as the second, third, fourth, and fifth proximal phalanges. This placement of the fore foot varus cushion pad being specifically designed for compensation of varus structural abnormalities of the fore foot region.

The present invention orthopedic compensatory devices have all been constructed of a urethane foam material ideally being of from 25 to 35 durometer hardness units, but may be formed in the range of from 10 to 40 durometer hardness units. Other materials having the resiliency of urethane foam material may be also utilized, and rubber or rubber-containing materials are similarly utilizable in this invention.

It must be further emphasized that the foregoing dimensions of the embodiment of the present invention are provided merely by way of explanation and are not intended to limit the invention in any fashion.

It should also be emphasized that an individual's specific foot structural abnormality might require more than one compensatory-corrective device being applied to one foot at the same time. An example of this might be the need for the clinical application of both a fore foot valgus corrective pad, as well as a calcaneous rear foot cushion pad in the subject's footwear. Further, it has been noted clinically, that in numerous cases a need for the application of the present compensatory-corrective devices to both of the subject's feet has been necessary in order to successfully resolve the clinical symptoms arising from the structural abnormalities of the feet.

A distinguishing feature of the present invention is the further availability of a multiple series of progressively graded sizes of the orthopedic compensatory-corrective devices, allowing a specific choice for a structural abnormality correction to be properly made.

Extensive clinical studies have further indicated that prolonged and proper specific application of the compensatory-corrective devices of the present invention, have led consistently to marked clinical improvement in the symptoms arising from a subject's specific structural foot abnormality.

The method of action of the present invention is tied to a compensatory mechanism for specific foot structural abnormalities, in contra distinction to prior art wedges which tended to be primarily arch supports acting by a tendency of a wedge to push up on the foot arch.

While the invention has been described in connection with a preferred embodiment, it is understood that I do not intend to limit the invention to that embodiment. On the contrary, I intend to cover the alternatives, modifications, and equivalents as may be included within the spirit and scope of the invention as defined by the appended claims.

I claim:

1. An orthopedic compensatory-corrective device disposed in a subject's footwear to correct varus and valgus recessed structural abnormalities of the foot comprising a compensatory separate moveable cushion pad of a material wedge-shaped laterally of the foot exhibiting a hardness in the range of 15 to 22 durometer to be held between the subject's foot and footwear at the location of the recessed abnormality.

2. An orthopedic compensatory-corrective device as defined in claim 1 wherein the cushion pad is composed of a resilient urethane foam material.

3. An orthopedic compensatory-corrective device as defined in claim 1 wherein the cushion pad is composed of a resilient rubber or rubber-containing material.

4. An orthopedic compensatory-corrective device as defined in claim 1 wherein said cushion pad is essentially a parallelogram in outline form for fore foot abnormality correction.

5. An orthopedic compensatory-corrective device as defined in claim 1 wherein said cushion pad is essentially an irregular outlined shape and whose wedge shape is in the form of a truncated solid pyramid.

6. An orthopedic compensatory-corrective device as defined in claim 1 wherein said pads are adapted for fore foot abnormalities and are disposed in the subject's footwear in the region of the distal metatarsal bones.

7. An orthopedic compensatory-corrective device as defined in claim 1 wherein the pad is adapted for rear foot structural abnormalities and is designed to be disposed in the subject's footwear in the region of the calcaneum bone.

8. An orthopedic compensatory-corrective device as defined in claim 1 wherein the lower surfaces of the individual structural compensatory orthopedic pads are coated with an adhesive substance for secure and precise locationing in a subject's footwear.

9. The orthopedic corrective device as defined in claim 8 wherein the adhesive substance of the device is further covered with a protective layer prior to its application in a subject's footwear.

10. The method of compensating for a deformed foot of varus or valgus type wherein a recess exists between the bones of a foot and the inner sole of footwear which comprises placing at the location of the recess deformation a tapered pad to build the recessed portion outwardly to an extent to afford a useable surface to the added pad to transfer pressure to the recess or overhanging portion to the inner sole of footwear.

11. The method of claim 10 wherein the taper of the tapered pad is selected to approximate the recess.

12. The method of claim 10 wherein the taper of the tapered pad is selected to approximate the recess, said pad having a durometer in the range of 15 to 22.

* * * * *